US005892147A

United States Patent [19]

Garnes et al.

[11] Patent Number: 5,892,147

[45] Date of Patent: Apr. 6, 1999

[54] METHOD FOR THE DETERMINATION OF INFLOW OF OIL AND/OR GAS INTO A WELL

[75] Inventors: Jan Magne Garnes, Sandviken; Siamos Anastasios, Nesttun, both of Norway

[73] Assignee: Norsk Hydro ASA, Oslo, Norway

[21] Appl. No.: 883,955

[22] Filed: Jun. 27, 1997

[30] Foreign Application Priority Data

Jun. 28, 1996 [NO] Norway ..... 962771

[51] Int. Cl.[6] ..... F21B 45/00

[52] U.S. Cl. ..... 73/152.14

[58] Field of Search ..... 73/152.14, 152.36, 73/152.39

[56] References Cited

U.S. PATENT DOCUMENTS

| | | | |
|---|---|---|---|
| 3,016,960 | 1/1962 | Hall, Jr. | 73/152.14 |
| 3,848,124 | 11/1974 | Vann . | |
| 3,949,220 | 4/1976 | Sparlin et al. . | |
| 3,993,902 | 11/1976 | Neuman | 250/258 |
| 3,993,903 | 11/1976 | Neuman . | |
| 4,066,216 | 1/1978 | Cubberly, Jr. | 250/260 |
| 4,071,756 | 1/1978 | Casad . | |
| 4,076,980 | 2/1978 | Arnold et al. | 73/152.14 |
| 4,166,216 | 8/1979 | Cubberly, Jr. . | |
| 4,189,638 | 2/1980 | Arnold . | |
| 4,420,565 | 12/1983 | Schmitt . | |
| 4,982,604 | 1/1991 | Davis et al. | 73/153 |
| 5,212,093 | 5/1993 | Richardson et al. . | |
| 5,256,572 | 10/1993 | Tang et al. . | |
| 5,328,849 | 7/1994 | Smith . | |
| 5,571,962 | 11/1996 | Georgi et al. | 73/152.04 |

FOREIGN PATENT DOCUMENTS

| | | |
|---|---|---|
| 169199 | 2/1992 | Norway . |
| 178946 | 3/1996 | Norway . |

*Primary Examiner*—George Dombroske
*Assistant Examiner*—Jewel V. Thompson
*Attorney, Agent, or Firm*—Wenderoth, Lind & Ponack, L.L.P.

[57] ABSTRACT

A procedure to determine the inflow of oil and/or gas from an oil and/or gas reservoir under the surface of the Earth into a wellbore in the reservoir. Traceable material with different identifying characteristics, e.g. different radioactive isotopes, is separately inserted or arranged in connection with different zones, places or regions along the length of the well. During production of oil and/or gas identification of the amount of the individual traceable materials permits the calculation of the amount of oil and/or gas flowing into the well at a particular place, zone or region of the well. The traceable material may be a radioactive isotope or genetically coded material.

11 Claims, 2 Drawing Sheets m TVD
MSL
2050
2100
2094
2050
2100
5927
4101
MEASURED DEPTHS RKB
1
2
3
4
5
6
7
8
9
10
11
12
13

METHOD FOR THE DETERMINATION OF INFLOW OF OIL AND/OR GAS INTO A WELL

The present invention relates to a method for determining the inflow of oil and/or gas from an oil and/or gas reservoir under the surface of the Earth into tubing inserted into a well in the reservoir. More precisely the invention relates to a method to determine the inflow at certain places along the whole or parts of such a well.

During production of oil or gas as mentioned above it is of decisive importance to ascertain first and foremost whether any oil and/or gas is being produced at all, but also how much oil and/or gas is being produced from the various areas or reservoirs under the surface of the Earth.

A previously known method for examining production is to lower a logging tool into an oil and,(or gas producing well. The logging tool is lowered into the well by means of special equipment and is designed to measure the amount of oil and/or gas flowing into the well at different places along it. By this means the amount of oil flowing into any region of the well can be calculated with a certain degree of accuracy.

A fundamental disadvantage of this solution is however that for long horizontal boreholes, i.e. boreholes with a length greater than 5 km, it is either impossible or only partially possible to lower the logging tool into the oil and/or gas producing areas of the borehole. Hence, in many cases, it will be impossible to use such logging tools. Another disadvantage of logging tools is that the production of oil and/or gas must be wholly or partially stopped which in its turn implies an economic loss. In addition the method is in itself expensive to use.

The injection of traceable materials into a borehole connected with an oil and/or gas reservoir is previously known. When such a reservoir of oil and/or gas is discovered the size and shape of the find must be determined. The field is divided into a number of geometrical squares which are equipped with boreholes. Injectors are placed in certain of these boreholes in a definite pattern and at various depths. The tracer is injected from the injectors into the oil and/or gas reservoirs and the amount of the tracer or tracers is subsequently measured in fluid samples taken in the producing boreholes. The injections of tracers may be repeated after a certain time at intervals which are dependent on the contents of the reservoir and its permeability, temperature and pressure as well as on the characteristics of the tracer. This method can, however, not be used to determine the inflow of oil and/or gas into a well.

The present invention on the other hand consists of a method to determine such inflow which is simple in application, uses simple and inexpensive equipment, gives a high degree of measuring accuracy and does not imply a halt in oil and/or gas production.

The method is based on the application of traceable material, preferably radioactively traceable material, and is characterised by the separate addition of traceable materials with different identifying characteristics, e.g. different radioactive isotopes to an oil soluble substance which is inserted or arranged in connection with different zones, places or regions along the length of the well, so that, during the production of oil and/or gas, the amount of oil and/or gas flowing into the well at the various places, zones or regions may be calculated on the basis of the identification of the amount of the various traceable materials.

The non-independent claims 2–4 describe advantageous features of the invention.

The invention is described below by means of examples and with reference to the plans where:

As mentioned above, FIG. 1 shows a subsurface formation with a well which descends at an angle to the surface, from a rig, drilling platform or similar (not shown) and continues nearly horizontally along the oil/gas-bearing layer 2 in the formation. Such wells can have a total length of 8–9 km, while the oil or gas-producing part can be 1–4 km long.

Figures 1, 2:
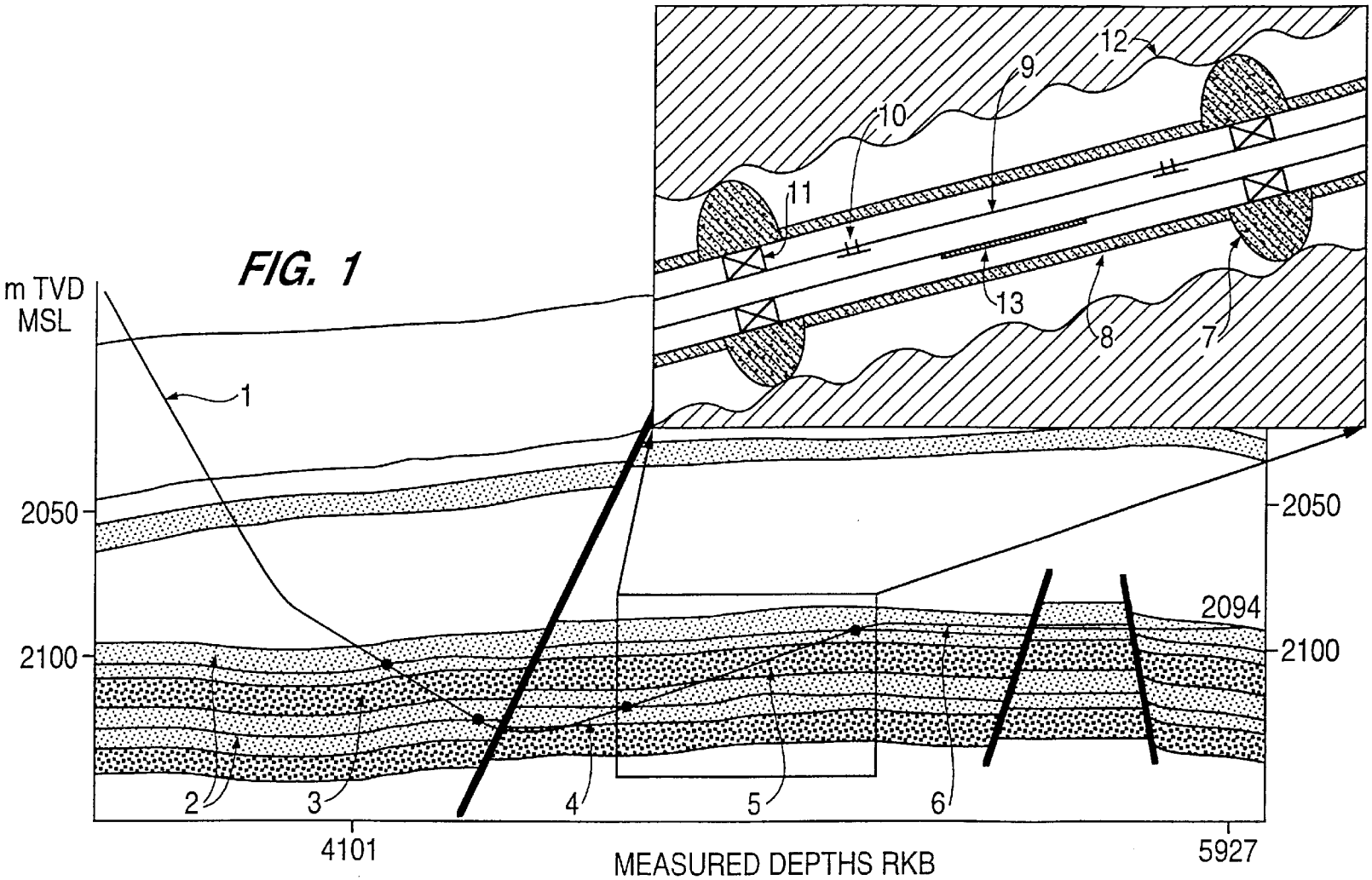
FIG. 1 shows in section a subsurface formation with a well which extends from the surface and through various oil/gas producing layers in the formation.
FIG. 2 shows at larger scale an region of the well shown in FIG. 1.

In the example shown in FIG. 1 the tubing is divided into zones 3, 4, 5 and 6 which are separated from each other by means of expandable packer elements 7 which are filled with cement and which are shown in more detail in FIG. 2. The "well" consists in this case of an external circular sand control filter 8 which is held in place by the packer elements 7 in borehole 12, together with an inner transport pipe 9 with valves 10 to control the supply of oil and/or gas to the inner pipe. The inner transport pipe is "divided" and held concentrically with the sand control filter 8 by means of the packer element 11.

In accordance with the invention each of these zones may be supplied with a traceable material, e.g. a radioactive isotope which, depending on the amount of oil/gas flowing into the well from the reservoir in the various zones, will accompany the oil/gas flow to the surface where the traceable materials can be identified and the amount of oil/gas from the various zones may be calculated.

The traceable material can be conveniently added to an oil-soluble martial e.g. tar materials (Tectyl®, Dynol® etc.) which are coated as a layer on the outside of transport pipe 9.

Figure 3:
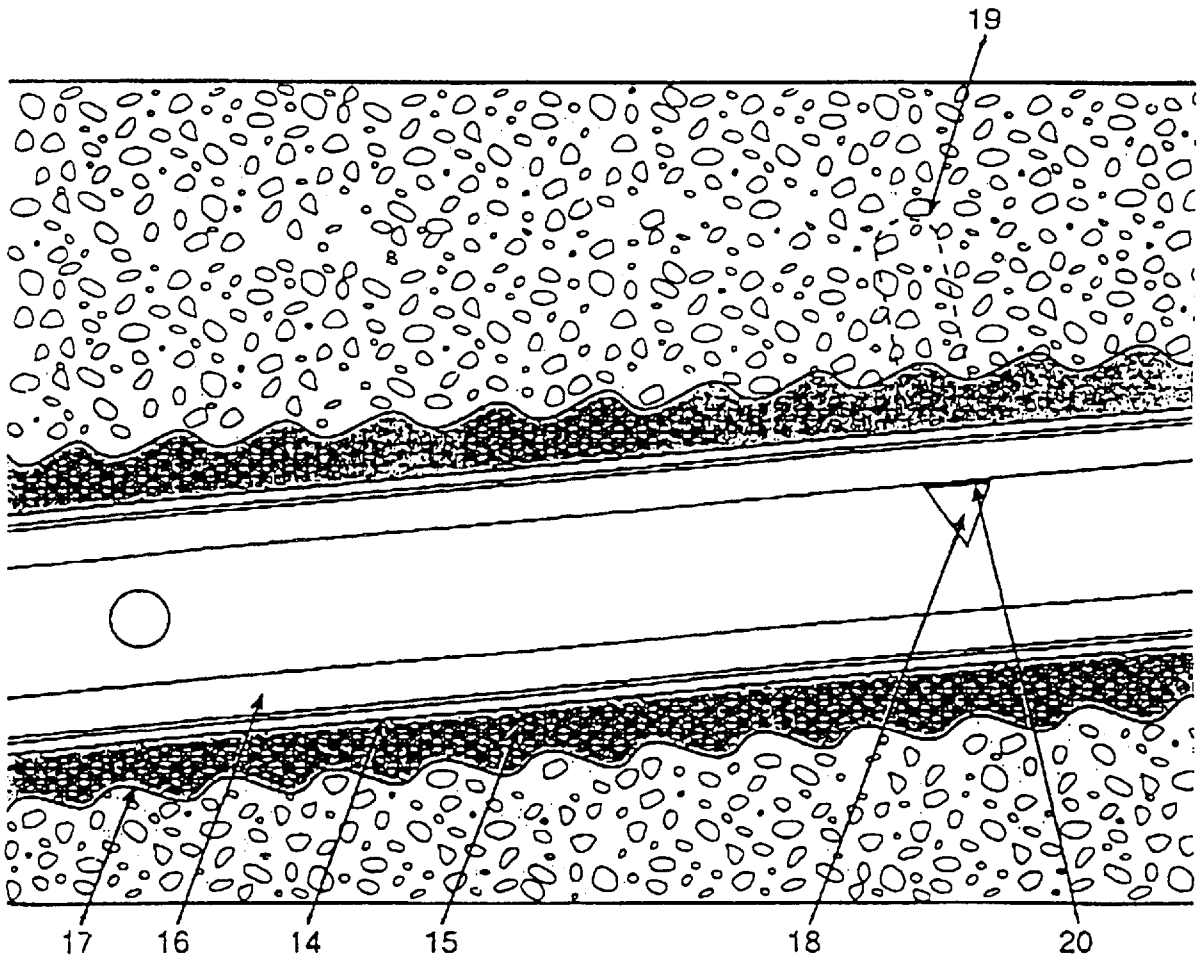
FIG. 3 shows on the same scale as FIG. 1 a corresponding region but for a different well with different well completion.

FIG. 3 shows at the same scale as FIG. 2 a corresponding area but for a different well with different well completion. In this case the "well" consists of a casing 14 which is permanently fixed in the wellbore 17 by means of cement 15. During well completion, before the start of production, a perforator gun 16 supplied with a large number of explosive charges 18 is lowered into the well where the charges are exploded simultaneously. The explosions make a hole 19 (suggested by the dashed lines) which extend through the casing and cement and into the formation. By this means contact is established between the formation and well so that oil and/or gas may flow freely in the pipe.

In this case the invention makes use of traceable material attached to each of the explosive charges 18. For example, the traceable material may be mixed with glue contained in a package (bag) and placed at 20 on the outside of each explosive charge 18, The traceable material is deposited in the perforation holes 19 when the charges are detonated. When the perforator gun is withdrawn and oil/gas-production starts the amount of oil/gas flowing into the well from each hole may be determined.

EXAMPLE

An experiment was performed in connection with the invention as described above with reference to FIG. 3, that is to say, by shooting in traceable material when perforating a well with the use of a perforator gun.

The amount of traceable material was calculated on the basis of information acquired concerning the amount of oil expected to be produced. It was assumed that at the beginning of oil production the concentration of traceable material would be greatest and that the radiation would decay exponentially towards the background level. It was further assumed that the traceable material would be produced in the course of the first two weeks at a production rate of 5000 $m^3$ per day.

Several radioactive isotopes were used as traceable material and the amount of each traceable material which needed to be shot into the well was calculated as 7×107 Bq (0.0002 Curie).

A suitable raw material of the desired chemical composition was synthesized and packed in small bags of polyethylene with a size of 0.75×0.75×0.10 cm. The bags were then irradiated to obtain the desired radioactive isotopes for the trial. Four different traceable materials (isotopes) distributed in 23 test bags were used during the trial.

Each bag was attached with epoxy glue to the explosive charges on a perforator gun at the various places desired and then completely covered by the same glue. All necessary safety precautions where taken to prevent undesirable exposure to radiation during the trials.

The perforation gun was then lowered into the "test well" and fired according to the usual procedures for such firing. Immediately afterwards the perforator gun was withdrawn and production of oil started.

The trial proved that the traceable materials (isotopes) were easily identifiable in the oil which was produced. Hence it was also possible to calculate the relative distribution of oil production for the various places along the well where the traceable materials were shot into the formation.

It should be noted that the invention as defined in the demands is not limited to radioactive traceable materials as mentioned in the previous example. Other traceable materials can also be employed such as genetically coded material.

We claim:

1. A method of determining the inflow of oil and/or gas from an oil and/or gas reservoir into a well having a borehole, the method comprising:

inserting an inner transport pipe into said borehole, wherein said transport pipe is divided into a plurality of zones;

providing a traceable material at each of said zones, such that each zone is provided with a traceable material having an identifying characteristic which is different from said identifying characteristics of said traceable materials provided at said other zones;

determining amounts of said individually traceable materials recovered during production of the well; and calculating flows of oil and/or gas into said borehole at locations which correspond to said zones based on the amounts of said individually traceable materials.

2. The method as claimed in claim 1, wherein said traceable materials, provided at said zones, comprise radioactive isotopes.

3. The method as claimed in claim 1, wherein each of said traceable materials are provided by mixing said traceable materials with a soluble substance, and coating the mixture on an outer wall surface of said inner transport pipe at each of said zones.

4. The method as claimed in claim 1, wherein said traceable materials comprise genetically coded materials.

5. The method as claimed in claim 4, wherein said borehole extends into said reservoir in both a horizontal direction and a vertical direction.

6. A method of determining the inflow of oil and/or gas from an oil and/or gas reservoir into a well having a borehole which extends into the reservoir, the method comprising:

fixing a casing in said borehole;

attaching a plurality of individually traceable materials to explosive charges, respectively, in a perforator gun, wherein each of said traceable materials has an identifying characteristic which is different from the identifying characteristics of the other traceable materials;

inserting said perforator gun into said casing prior to starting production of said well;

exploding said explosive charges simultaneously so as to form perforation holes and to deposit said traceable materials in said perforation holes;

determining amounts of each of the traceable materials recovered during production of the well; and calculating the flow of oil and/or gas into the well at each location of the well which corresponds to said perforation holes containing said traceable materials.

7. The method as claimed in claim 6, wherein said traceable materials comprise radioactive isotopes.

8. The method as claimed in claim 6, wherein said traceable materials comprise genetically coded materials.

9. A method of determining the inflow of oil and/or gas from an oil and/or gas reservoir into a well having a borehole which extends into the reservoir, the method comprising:

fixing a casing in said borehole;

placing a plurality of traceable materials in a plurality of packages, wherein each of said traceable materials has an identifying characteristic which is different from the identifying characteristics of the other traceable materials;

attaching said packages to a plurality of explosive charges, respectively, wherein said explosive charges are provided in a perforator gun;

inserting said perforator gun into said casing prior to starting production of said well;

exploding said explosive charges simultaneously so as to form perforation holes and to deposit said traceable materials in said perforation holes;

determining an amount of each of said traceable materials recovered during production of the well; and calculating the flow of oil and/or gas flowing into the well at locations which correspond to said perforation holes containing said traceable materials.

10. The method as claimed in claim 9, wherein said traceable materials comprise radioactive isotopes.

11. The method as claimed in claim 9, wherein said traceable materials comprise genetically coded materials.

* * * * *